United States Patent [19]

Schäfer et al.

[11] Patent Number: 5,013,589

[45] Date of Patent: May 7, 1991

[54] PROCESS FOR THE PRODUCTION OF COATED OR LACQUERED METAL CONTAINERS AND THE USE THEREOF

[75] Inventors: Dietrich M. Schäfer, Lindenberg, Fed. Rep. of Germany; Simon Kleijmeer, Stompetoren, Netherlands

[73] Assignee: Grace GmbH, Fed. Rep. of Germany

[21] Appl. No.: 481,671

[22] Filed: Feb. 14, 1990

Related U.S. Application Data

[63] Continuation-in-part of Ser. No. 429,594, Oct. 31, 1989, abandoned.

[30] Foreign Application Priority Data

Nov. 29, 1988 [DE] Fed. Rep. of Germany ..... 3840809

[51] Int. Cl.[5] ..... B65D 25/14

[52] U.S. Cl. ..... 428/35.9; 220/456; 428/413; 428/461

[58] Field of Search ..... 428/35.9, 461, 413; 220/456

[56] References Cited

U.S. PATENT DOCUMENTS 4,173,290 11/1979 Kobayashi et al. ..... 428/35.9
4,637,117 1/1987 Karas et al. ..... 72/42
4,646,930 3/1987 Karas et al. ..... 72/115

FOREIGN PATENT DOCUMENTS 0254755 7/1986 European Pat. Off. .
2029629 6/1970 Fed. Rep. of Germany .
875488 7/1987 South Africa .

*Primary Examiner*—James J. Seidleck
*Attorney, Agent, or Firm*—John Dana Hubbard; William L. Baker

[57] ABSTRACT

A process for the production of coated or lacquered metal containers for receiving foods is described, in which the internal coating takes place by first applying a vinylchloride-based organosol followed by baking for 8 to 15 minutes at 175° to 225° C. Then an epoxy-phenol lacquer is applied and also baked for 8 to 15 minutes at 175° to 225° C. The metal sheet is then shaped to the desired container. The shaping preferably takes place by deep drawing and especially DRD deep drawing. The double coating results in improved properties of the internal coating and has the particular advantage that colorings, which are set free from coloring delivering filled products, are not absorbed so that there is no staining when emptying the container.

11 Claims, No Drawings

PROCESS FOR THE PRODUCTION OF COATED OR LACQUERED METAL CONTAINERS AND THE USE THEREOF

This is a continuation-in-part of co-pending application Ser. No. 07/429,594 filed on Oct. 31, 1989, now abandoned.

The invention relates to a process for producing coated or lacquered metal containers for receiving foods and the use thereof for the packing of shrimps, prawns and crab.

BACKGROUND OF THE INVENTION

Metal containers for receiving foods generally have a coating, so as to prevent contact between the filled product and the metal, so that there is no disadvantageous influence on the quality of said product and so as to prevent corrosion to the metal by said product. For producing containers of this type, such as tin cans, use is made of metal sheets which, prior to their deformation or shaping, are provided with a suitable coating. The known epoxy-phenolic lacquers are suitable for this purpose and as a result of their colour tone they are also referred to as gold lacquers. Of late and in particular in conjunction with modern processing and deformation processes (cf. below) more and more PVC-based organosols have been used, which in addition generally contain a phenolic resin, a polyester resin, a diluent, a catalyst, a polymer plasticizer and optionally conventional additives (cf. e.g. German Patent 20 29 629 and European patent application 254 755).

Of the various processing and deformation processes which can be used, within the scope of the present invention particular interest is attached to deep drawing and more especially multi-stage DRD deep drawing (draw and redraw). These processing and deformation processes make increased demands on the sheet metal coating, i.e the coating must not only be as free as possible from pores and cracks and adhere well, but must also have a good drawing property or capacity, so that the afore-mentioned characteristics are also present following deep drawing. Whereas for the production of three-part tin cans use is made of sheet metal thicknesses of approximately 0.19 to 0.25 mm, for DRD deep drawing harder, but thinner metal sheets with a thickness of 0.18 mm and less are used. A suitable material is e.g. tin plate. However, preference is given to metal sheets, which are given an extremely thin chromium surface coating.

The afore-mentioned organosols are particularly suitable for the coating of metal sheets, which are to be shaped or deformed in accordance with the afore-mentioned deep drawing processes. The organosol is applied prior to the deformation of the sheet (normally after a roll coating process) and is then normally baked for 8 to 15 minutes at approximately 175° to 225° C. For this purpose the metal sheet is generally passed through a drying tunnel. In the case of two-sided sheet metal coating, the organosol is firstly applied to one side of the sheet and then baked and subsequently the other side of the sheet is treated in the same way. As a function of the intended use, the coating thicknesses are between 7 and 30 g (dry weight) per $m^2$. It is important that the coating adheres well, has no pores and cracks and is mechanically stable, so that a coating or lacquer is obtained, which is resistant to corrosion and sterilization and which is not sensitive to mechanical stresses.

Although PVC-based organosols lead to coatings which largely meet the demands of deep drawing processes, there is a considerable need for further improvements to the coating characteristics, i.e. in particular for a further reduction to the porosity and an improvement to the stability with respect to more or less aggressive filled products. Reference is also made in this connection to the prevention of the diffusing of the plasticizer into the filled material. An important disadvantage of coatings based on PVC-containing organosols is that the PVC absorbs colourings like the pink colouring of the shrimps and crabs, so that when emptying a can filled with such a product, an unattractive pink staining can be seen on the internal coating which, although admittedly not impairing the product quality, is certainly an irritant to the user.

Another possibility for the coating of metals for the production of receptacles such as tin cans, tubes and sheet metal containers of all types is the afore-mentioned use of epoxy-phenolic lacquers, which are applied to the sheet metal in the same way as the afore-mentioned organosols and are then baked for 8 to 15 minutes at approximately 175 to 225° C. The resulting coatings have excellent characteristics and in particular a very good chemical stability and therefore resistance to the action of aggressive filled products. However, these lacquers suffer from the disadvantage that resistance to aggressive filled products is not combined with adequate elasticity and that therefore they are not drawable and can consequently not be used for deep drawing processes and especially DRD deep drawing processes.

The problem of the invention is to further improve the coatings and in particular the inside coatings of metal containers for receiving foods and to avoid the afore-mentioned disadvantages of the known coatings.

SUMMARY OF THE INVENTION

According to the invention this problem is solved by a process for the production of coated or lacquered metal containers for receiving foods, in which a conventional PVC-based organosol is applied to the surface, subsequently forming the container inside, of a metal sheet of appropriate form and thickness and of a suitable material and is then baked for 8 to 15 minutes at 175° to 225° C., which is characterized in that an epoxy-phenolic lacquer is applied to the organosol coating and baked for 8 to 15 minutes at 175° to 225° C. before the sheet metal is shaped to the desired container.

The invention also relates to the use of the containers produced according to the process of the invention for packing colouring delivering filled products, particularly shrimps, prawns and crabs.

DETAILED DESCRIPTION OF THE INVENTION

As a result of the inadequate elasticity of epoxy-phenolic lacquers and the poor compatibility thereof with thermoplastics based on PVC-containing organosols, the inventive combination of the two coatings appears to be completely inappropriate. However, it has surprisingly been found that the compatibility between epoxy-phenolic lacquers and coatings based on PVC-containing organosols is well enough, particularly if the baking of the organosol takes place under somewhat milder conditions than are typically used with organosols alone. In addition, the elasticity behaviour of the epoxy-phenolic lacquers is improved to such an extent through the application to the organosol priming coating that the double coating is able to withstand the stresses of the deep drawing process, particularly the DRD deep drawing process, i.e. the thus produced lacquers or coatings have an extremely low porosity combined with an optimum chemical stability. It has also been found that the afore-mentioned undesired staining when packing colouring delivering filled products, particularly shrimps, prawns and crabs does not occur in the containers produced according to the invention, i.e. when removing the filled product the internal coating does not have unattractive pink staining.

Another advantage of the inventive double varnish coating is that the plasticiser content of the PVC-based organosol is no longer as critical, because it essentially does not diffuse through the epoxy-phenolic lacquer. This reduced plasticizer diffusion also leads to improved sterilization characteristics, which is in accordance with modern developments, because nowadays for economic reasons shorter sterilization times at higher sterilization temperatures are sought.

For the first coating, use is made of PVC-based organosols. They contain as the main component pulverulent PVC, preferably in the form of fine-grain, neutral homopolymerisate with a Brookfield viscosity in the range of 2000 to 6300 cp. The organosol preferably also contains a vinylchloride copolymer (e.g. a vinylchloride-vinylacetate-maleic acid copolymer), which contributes to the good adhesion of the epoxy-phenolic lacquer to the baked organosol coating.

Apart from the vinylchloride homopolymer and the vinylchloride copolymer suitable organosols conventionally contain as further important components phenolic resin, epoxy resin, polyester resin and/or acrylic resin. Suitable phenolic resins are thermosetting, nonplasticized phenol-formaldehyde-resol resins, which have a good compatibility with epoxy resins and vinylchloride homopolymers. For example, butanol-etherified phenolformaldehyde-resol resins are very suitable.

As epoxy resin, the suitable organosols preferably contain an epoxy resin with a molecular weight of 300 to 900 (number average) and a corresponding epoxy equivalent weight of 150 to 500. In particular non-modified, low- to medium-viscosity epoxy resins are suitable for the inventive purposes.

The polyester resin contained in the organosol serves both as a plasticizer and as an adhesion promoter. The same adhesion promoting effect is also to be attributed to the optionally present acrylic resin. The organosol conventionally further contains epoxidized oils, preferably epoxidized soy oil, which on the one hand serve as plasticizers and on the other hand as acceptors for PVC split-off products (mainly HCl).

Further conventional components of the organosol are additives such as lubricants (e.g. lanolin), catalysts (e.g. tin octoate or p-toluenesulphonic acid ester), pigments (e.g. aluminum pigments), stabilizers, dyes, fillers and other lacquer aids. The organosol solvent is matched in such a way that excessive swelling of the PVC is avoided, whilst ensuring an adequate dissolving of the other components.

The quantitative proportions of said components are dependent on the desired processing characteristics of the organosol and the desired characteristics of the baked lacquer coating. Suitable quantity ranges and other details in connection with the afore-mentioned components appear in the prior art, e.g. in European patent application 254 755 which is incorporated by reference.

For the second layer of the double coating according to the invention, an epoxy-phenolic lacquer is used. Such lacquers are well known for the lacquering of tin cans. It is applied in the form of a solution of an epoxy resin and a phenolic resin in organic solvents, said solution advantageously containing small amounts of catalysts (e.g. phosphoric acid) and lubricants (e.g. lanolin, polyethylene wax). Suitable epoxy resins are in particular products with a high molecular weight based on bisphenol A. These products have epoxy equivalent weights in the range of approximately 1500 to 3000 g. The phenolic resin can be constituted by known products used for this purpose, preference being given to hardenable, nonplasticized phenol-resols.

For obtaining especially flexible epoxy-phenol coatings it has been found advantageous to use the epoxy resin and the phenol resin in form of a precondensate. Such precondensates are commercially available, but can also be prepared by prepolymerization before the application of the lacquer.

The organosol applied to the metal sheet is baked for 8 to 15 minutes at 175° to 225° C. and preferably for about 10 minutes at 180° to 200° C. The epoxy-phenolic system is then applied and also baked for 8 to 15 minutes at 175° to 225° C., a 10 minute baking at 200° C. being preferred.

The thickness of the inventively used double coating is in the conventional range between 7 and 30 g (dry weight) per $m^2$ and is preferably 10 to 15 $g/m^2$.

The sheet metal side subsequently forming the container outside should also be coated for technical reasons of processing. For this purpose organosol or epoxy-phenolic coatings can be used. This is a function of the intended use of the inventively produced container. If desired, the sheet metal side subsequently forming the container outside can be provided with a double coating in the above described way. The application of the coating to the sheet metal side subsequently forming the container outside usually takes place in a process step preceeding the coating step of the sheet metal side subsequently forming the container inside. However, it can also take place at the same time or at an intermediate or subsequent process step depending upon the production facilities.

The coated sheet metal is then shaped to the desired container. This shaping preferable takes place by deep drawing and especially by DRD deep drawing, preference being given to chrome-plated (see above) or tin-plated metal sheets. These are so-called ECCS (electrolytical chromium coated steel) or ETP (electrolytical tin plate) metal sheets.

EXAMPLE

Conventional tin plate and ECCS metal sheets were coated with the following lacquers:

COMPARATIVE LACQUER 1

By mixing the stated ingredients an organosol with the following composition was prepared:

| | |
|---|---|
| Vinylchloride homopolymerisate | 29.20 wt. % |
| Vinylchloride copolymerisate | 6.80 wt. % |
| Phenolic resin A | 3.20 wt. % |
| Epoxy resin A | 3.40 wt. % |
| Acrylate resin | 6.80 wt. % |
| Aluminum pigment | 5.00 wt. % |
| Catalyst B | 0.02 wt. % |
| Lubricant | 1.00 wt. % |

-continued

| | |
|---|---|
| Diluent blend A | 44.58 wt. % |
| | 100.00 wt. % |

COMPARATIVE LACQUER 2

By mixing the stated ingredients an epoxy-phenolic lacquer with the following composition was prepared:

| | |
|---|---|
| Epoxy resin B | 24.50 wt. % |
| Phenolic resin B | 10.50 wt. % |
| Lubricant | 1.00 wt. % |
| Catalyst A | 0.60 wt. % |
| Diluent blend B | 63.40 wt. % |
| | 100.00 wt. % |

LACQUERS ACCORDING TO THE INVENTION

By mixing the stated ingredients an organosol with the following composition was prepared:

| | |
|---|---|
| Vinylchloride homopolymerisate | 29.20 wt. % |
| Vinylchloride copolymerisate | 6.80 wt. % |
| Phenolic resin A | 3.20 wt. % |
| Epoxy resin A | 3.40 wt. % |
| Polyester resin | 6.80 wt. % |
| Catalyst B | 0.02 wt. % |
| Aluminum pigment | 5.00 wt. % |
| Lubricant | 1.00 wt. % |
| Diluent blend A | 44.58 wt. % |
| | 100.00 wt. % |

By dissolving, mixing and pre-condensating of the stated ingredients an epoxy-phenolic lacquer for the second layer was prepared:

| | | |
|---|---|---|
| Epoxy resin B | 24.60 wt. % | pre-condensation: 48 hours at 80° C. |
| Phenolic resin B | 5.40 wt. % | |
| Diluent blend B | 48.50 wt. % | |
| Catalyst A | 0.50 wt. % | |
| Diluent blend B | 20.00 wt. % | |
| Lubricant | 1.00 wt. % | |
| | 100.00 wt. % | |

Cans drawn from the so coated metal sheets were subjected to the following tests:

(A) Porosity Test

Electrolytical conductivity after filling the cans to be tested with a suitable electrolyte is considered to be a measure for lacquer quality. The indication on the test apparatus was in mA.

(B) Sterilisation Test 121° C./30 Min.

The following food simulating substances were used:

(i) water (ii) 1.5% acetic acid solution +3.0% sodium chloride solution (iii) 1% lactic acid solution (iv) 2% sodium chloride solution (v) soybean oil Water absorption and blister formation were evaluated.

The results obtained are summarized in the following table.

TABLE[1]

| Lacquer Coating | Comparative Lacquer 1 10-15 g/m² | Comparative Lacquer 2 10-15 g/m² | Double Coating according to Invention 10-15 g/m² |
|---|---|---|---|
| | Tin plate metal sheet | | |
| (A) Porosity | <10 mA | >125 mA | <5 mA |
| (B) Sterilisation test in media | | | |
| (i) | 1 | 1 | 1 |
| (ii) | 2 | 3-4 | 1 |
| (iii) | 2 | 3 | 1 |
| (iv) | 1 | 2-3 | 1 |
| (v) | 1 | 1-2 | 1 |
| | ECCS Metal Sheets | | |
| (A) Porosity | <10 mA | >125 mA | <5 mA |
| (B) Sterilisation test in media | | | |
| (i) | 1 | 1 | 1 |
| (ii) | 3-4 | 4-5 | 1-2 |
| (iii) | 2 | 4 | 1 |
| (iv) | 1 | 2-3 | 1 |
| (v) | 1 | 1-2 | 1 |

[1]Evaluation:
1 = very good
2 = good
3 = satisfactory
4 = sufficient
5 = deficient In the described tests the following materials were used:

VINYLCHLORIDE HOMOPOLYMERISATE

Conventional, commercially available, pulverulent vinylchloride homopolymerisate with a Brookfield viscosity of 2000 to 6000 cps.

VINYLCHLORIDE COPOLYMERISATE

Solution of a conventional, commercially available vinylchloride copolymerisate on the basis of VC/VAc/maleic acid in a ketone/solvent blend. The stated amounts are based on the solid parts of the vinyl chloride copolymerisate.

PHENOLIC RESIN A

Commercially available butanolized, non-plasticized phenol formaldehyde-resol-resin solution in alcohol. The stated amounts are based on the solids of the phenolic resin solution.

PHENOLIC RESIN B

Mixture of two conventional, commercially available, hardenable, non-plasticized phenolic resins.

EPOXY RESIN A

Conventional, commercially available liquid epoxy resin with an epoxy equivalent weight of 150 to 500 and a gram/molecular weight of 300 to 900.

EPOXY RESIN B

Conventional, commercially available, liquid epoxy resin with an epoxy equivalent weight of 1600 to 2000 and an average gram/molecular weight of 2900.

POLYESTER RESIN

Conventional, commercially available, oilfree, saturated polyester resin with a softening range of 75° to 85° C.

ACRYLATE RESIN

Conventional, commercially available, thermoplastic MMA/BMA copolymer resin with a softening range of 150°to 160° C.

PLASTICIZER

Conventional, commercially available, epoxydized soybean oil with an epoxy content>6%.

CATALYST A

50% solution of phosphoric acid (85%) in alcohol.

CATALYST B

Tin octoate solution with a metal content of 26%.

LUBRICANT

20% emulsion of lanolin in an aromatic hydrocarbon blend as diluent.

ALUMINUM PIGMENT

Conventional, commercially available aluminum paste consisting of 65 parts by weight of a finely divided flaky aluminum pigment and 35 parts by weight of a hydrocarbon blend.

DILUENT BLEND A

Blend comprising the following components:

| | |
|---|---|
| Aromatic hydrocarbons | 25.00 wt. % |
| Alcohols | 5.00 wt. % |
| Ketones | 70.00 wt. % |
| | 100.00 wt. % |

DILUENT BLEND B

Blend comprising the following components:

| | |
|---|---|
| Glycolether | 55.00 wt. % |
| Aromatic hydrocarbons | 35.00 wt. % |
| Alcohol | 10.00 wt. % |
| | 100.00 wt. % |

Cans produced according to the process of the invention when compared with those having the known coatings (deformation always took place by DRD deep drawing) gave very satisfactory results in the porosity test (Waco test) and in sterilization tests (30 minutes; 121° C.) in water, in 1% lactic acid, in a solution containing 1.5% acetic acid and 3% sodium chloride, in oil, and in 2% saline solution, and in all the tests carried out were ate least as good, but usually better than the known coatings.

While the present invention has been described in relation to the preferred embodiments, other embodiments can achieve the same results. Variations, modifications and equivalents of the present invention will be obvious to one skilled in the art and it is intended int eh appended claims to cover all such variations, modifications and equivalents as fall within the true scope an spirit of the present invention.

What is claimed is:

1. A coating for a metal sheet capable of being formed into a container comprising a double coating, a first layer of the coating being formed of a vinyl chloride-based organosol applied to at least one surface of the metal sheet which subsequently forms an inner surface of the container, and a second layer formed on the first layer and composed of an epoxy-phenolic lacquer.

2. The coating of claim 1 wherein the organosol is formed of a polyvinylchloride polymer and a plasticizer.

3. The coating of claim 1 wherein the epoxy-phenolic lacquer is formed of a precondensate of a bisphenol A epoxy resin and a phenol-resol resin.

4. The coating of claim 1 wherein the sheet metal is selected from the group consisting of ECCS sheet metal or ETP sheet metal.

5. The coating of claim 1 wherein the first and second layers are applied to at least the surface of the metal sheet which forms the inner surface of the container before the container is formed and the first and second layers are heated at a temperature of from about 175° to 225° C. for a period of time of from about 8 to about 15 minutes.

6. A metal container comprising a metal substrate having an inner surface and an outer surface and a coating formed on at least the inner surface, wherein the coating is comprised of a first layer of a vinyl chloride-based organosol applied to the inner surface and a second layer composed of an epoxy-phenolic lacquer and formed on the first layer.

7. The metal container of claim 6 wherein the organosol is formed of a polyvinyl chloride polymer and a plasticizer, the epoxy-phenolic lacquer is formed of a precodensate of a bisphenyl A epoxy resin and a phenol-resol; and the metal substrate is selected from the group consisting of eletrolytical chromium coated steel and electrolytical tinplate.

8. The metal container of claim 6 wherein the coating is applied to the metal substrate before the formation of the container's inner and outer surfaces.

9. A metal sheet for use in the formation of a deep drawn two piece container comprising a metal substrate having a first and second surface, the metal substrate being selected from the group consisting of electrolytical chromium coated steel and electrolytical tinplate, and at least the first surface is covered by a coating comprised of a first layer formed of a vinyl chloride-based organosol applied to the metal surface and a second layer formed of an epoxy phenolic lacquer applied to the first layer.

10. The metal sheet of claim 9 wherein the organosol is formed of a polyvinyl chloride polymer and a plasticizer and the epoxy-phenolic lacquer is formed of a precondensate of a bisphenol A epoxy resin and a phenol-resol resin.

11. In a metal container formed by a draw redraw drawing process and having a coating formed on an inner surface of the container, the improvement comprising a coating formed of a first layer of an organosol applied to the inner surface of the container and a second layer of an epoxy-phenolic lacquer applied to the first layer and wherein the coating is applied to the inner surface of the container prior to the draw redraw drawing process.

* * * * *